United States Patent [19]

Strahan

[11] 4,192,075

[45] Mar. 11, 1980

[54] PLATFORM RAMP SIGHT FOR FIREARMS

[76] Inventor: Travis R. Strahan, Rte. 7, Townsend Cir., Ringgold, Ga. 30736

[21] Appl. No.: 974,053

[22] Filed: Dec. 28, 1978

[51] Int. Cl.[2] ..... F41G 1/02

[52] U.S. Cl. ..... 33/257; 33/233; 42/1 S

[58] Field of Search ..... 33/243, 252, 257, 258, 33/260, 233, 241, 242; 42/1 S

[56] References Cited

U.S. PATENT DOCUMENTS 2,484,368 10/1949 Young ..... 33/252

4,130,958 12/1978 Gutridge ..... 42/1 S

*Primary Examiner*—William D. Martin, Jr.

*Attorney, Agent, or Firm*—Alan Ruderman

[57] ABSTRACT

A target sight for handguns includes a rear notched rib sight and a front ramp sight together on a platform. The ramp extends from the front of the sight platform rearwardly to adjacent the rear sight. The platform is mounted on a base member which is secured to the gun. The mounting of the platform on the base includes a pivotable mounting so that the platform may be adjusted vertically and laterally relatively to the base and the gun.

11 Claims, 4 Drawing Figures

PLATFORM RAMP SIGHT FOR FIREARMS

BACKGROUND OF THE INVENTION

This invention relates to firearms and more particularly to an improved target aiming sight, especially for handguns.

In the known modern guns the sighting of a target makes use of a blade type front sight located at the front of the gun barrel and a notch type rear sight in a rectangular rib located behind the barrel on the barrel supporting frame. The blade is a small upstanding tab or a small angular tab, which, when sighting a target, is laterally aligned within the notch and vertically aligned so that the top of the blade is level with the top of the rectangular rib. When firing a gun having this type of sight, and especially when rapidly firing a revolver, difficulty is experienced in aligning the front and rear sights and maintaining the alignment for more than a very short period. This militates against accurate firing of a gun, which reduces marksmanship and thus the scores of a competitive marksman.

Moreover, the known customized sights include means for adjusting either the rear sight or both sights to compensate for distance, elevation and windage. These known adjustable sights, however are small independent elements mounted on a sighting base and are adjustable relative to one another. Because of the mounting, there is a high degree of vertical, and in some cases also horizontal play in the sights. Also because of their independence of one another when one is accidently moved relative to the other the accuracy of the sight is impaired.

SUMMARY OF THE INVENTION

The present invention provides a novel gunsight which is easily and quickly aligned to sight a target with great accurracy. The sight includes a notched rib rear sight but the front sight comprises a tapered ramp extending from the front of the sight above the front of the gun barrel a substantial distance toward the rear sight and preferably proximate the rear sight. It has been found that the best results seem to occur the further back the front sight ramp extends. However, it appears that the results may be equally as good when the ramp extends rearwardly to a point at least above the gun cylinder of a pistol where the sight line with the bottom of the notch intersects the ramp so that not only will the ramp always be seen within the notch, but that no part of the ramp support will be seen to distract a target sighting.

With this arrangement the marksman will sight through the rear sight notch and align along the ramp to the top most portion thereof until the target is properly sighted. In this manner the sighting of a target is exceptionally rapid and can be maintained without distraction for substantially longer periods than conventional sights with a concomitant increase in marksmanship.

The front and rear sight are positioned on, and preferably integral with, a platform positioned on a base member. The platform is preferably pivotably mounted on the base for movement about at least one axis so that the platform may be adjustable both vertically and laterally relatively to the base member. With this construction a more rigid adjustable mounting is obtained than heretofore obtainable.

Consequently, it is a primary object of the present invention to provide a target sight for hand held firearms which is easy to use and which provides a quick alignment of a target accurately.

Another object of the invention is to provide a target gunsight having an elongated tapered front sight ramp extending from the front of the sight to adjacent the rear notched rib sight.

A further object of this invention is to provide a front sight comprising an elongated ramp mounted on a platform, the platform being mounted on a base member for movement vertically and laterally relatively to the base.

A still further object of this invention is the provision of an elongated ramp sight mounted on a common platform with a notched rear sight, the front sight ramp extending rearwardly to adjacent the rear sight, and the platform being mounted on a base member for vertical and lateral adjustment relatively thereto.

A yet further object of this invention is to provide a front sight and a rear sight mounted on a common platform, the platform being adjustably mounted for vertical and lateral movement on a base member adapted to be securred to the barrel of a gun.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
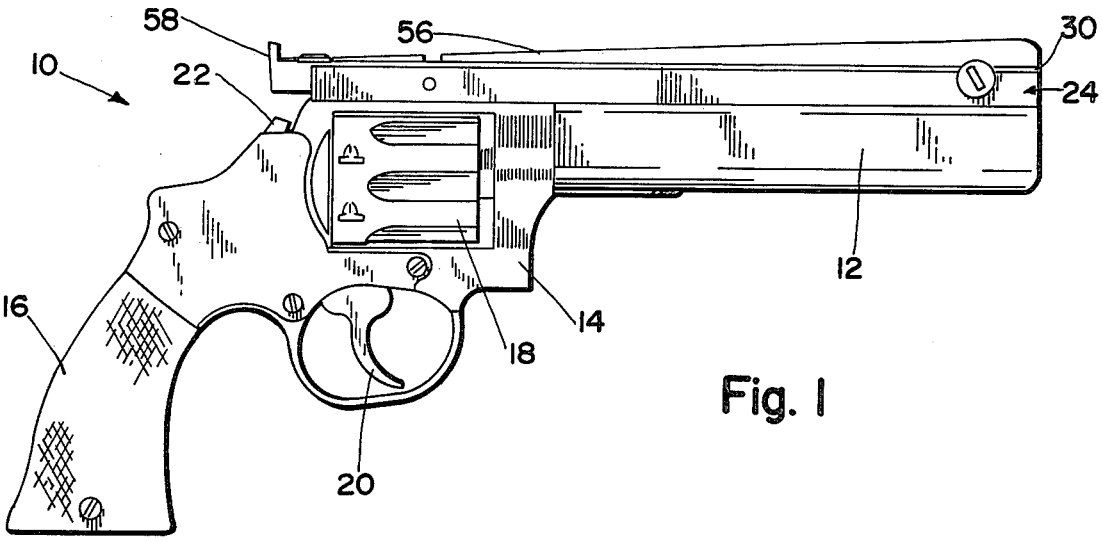
FIG. 1 is an elevational view of a gun embodying a sight incorporating the principles of the present invention.
Figure 2:
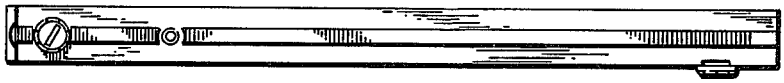
FIG. 2 is a top plan view of the sight illustrated in FIG. 1 removed from the gun.

Referring now to the drawings, FIG. 1 illustrates the preferred embodiment of the invention as applied to a revolver type handgun 10 having a barrel 12 secured to a frame 14. The gun, which includes a hand grip or handle 16, a cartridge cylinder 18, a firing mechanism including a trigger device 20 and a hammer 22, is conventional and forms no part of the present invention. The gun sight comprises a base member 24, with an arcuately shaped bottom surface 25, which may be secured to the barrel 12 and frame 14 by conventional means such as set screws 26 threaded into holes 28 tapped into the base member and into corresponding holes (not illustrated) in the barrel and frame, and a sight platform 30 mounted on the base member as hereinafter described. Although the invention is shown and described with regard to a revolver, the term hand-held gun is more generic and includes shotguns and rifles.

Figure 3:
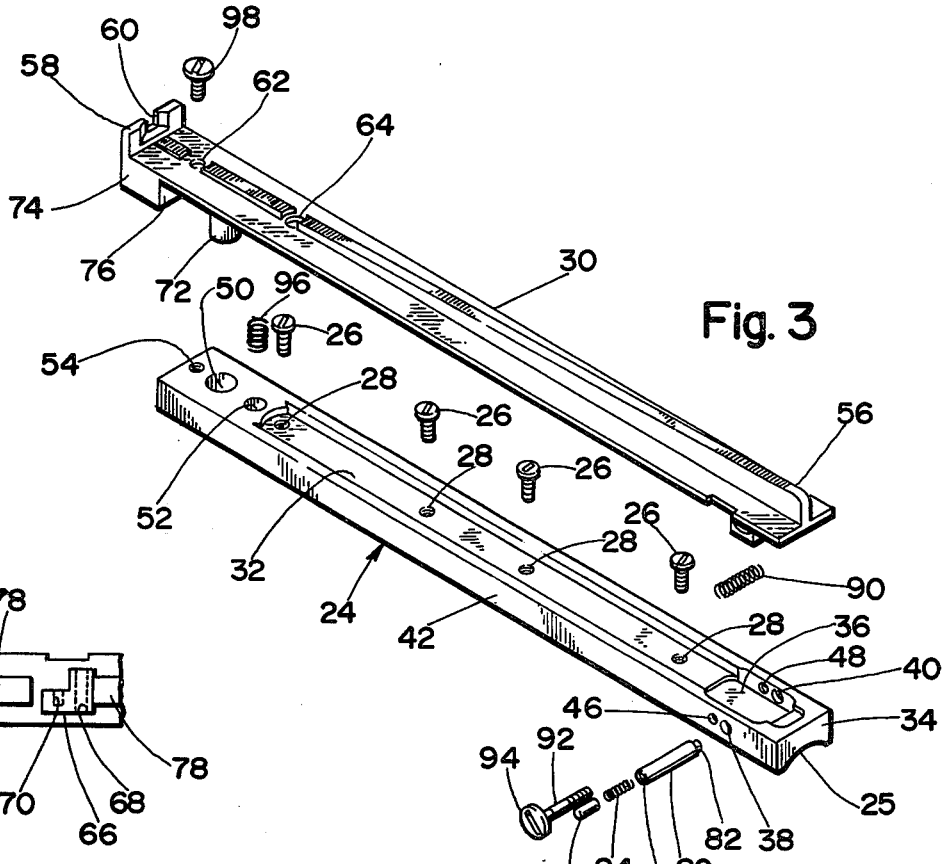
FIG. 3 is a disassembled perspective view of the sight illustrating the manner of mounting the sight platform on the base.
Figure 4:
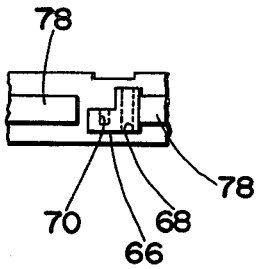
FIG. 4 is a fragmented view of a portion of the bottom of the sight platform in plan.

The base member 24, as illustrated in FIG. 3 comprises a substantially rectangular body having a longitudinal recess 32 formed therein and extending from adjacent the front end 34 for a substantial portion of the length of the base toward but spaced from the rear end. A small, but preferably deeper recessed portion 36 is formed slightly behind the leading portion of the recess 32 and includes a pair of laterally aligned spaced holes 38 and 40 in the respective side walls 42 and 44 of the base member, the hole 40 being slightly smaller than 38.

Another hole 46 is formed in the side wall 42 adjacent the hole 38 while an aligned socket 48 is formed in the wall 44 adjacent the hole 40. Formed vertically in the rear of the base member behind the recess 32 are three longitudinally spaced holes 50, 52 and 54, the hole 54 being a small threaded hole.

The sight platform 30 comprises an elongated member having an upstanding front sight ramp 56 longitudinally extending from the front edge of the platform rearwardly, and substantially centrally located laterally. The rear of the platform has an upstanding rib 58 including a centrally disposed notch 60. Preferably, the ramp 56, which as illustrated may be serrated, extends to adjacent the front of the rib and below the notch, with the exception of where a pair of gaps where holes 62 and 64 for adjusting purposes may be formed. The lateral thickness of the ramp 56 should be approximately equal to the lateral width of the notch 60 for good aiming results. The ramp 56 has its maximum elevation just behind the leading edge, which may have a slight curvature as illustrated, and is thereafter tapered rearwardly preferably at a constant angle terminating at the rib 58.

The bottom of the platform includes a depending lug 66 which, when the platform is positioned on the base member 24, is positioned within the recess 36. A bore 68 is formed in the lug 66 and is aligned with the holes 38 and 40 when the sight is assembled. A threaded bore 70 parallel to bore 68 is formed in a laterally reduced portion of the lug spaced longitudinally therefrom and is aligned with the hole 46 and socket 48 when assembled. A depression is thus formed axially of the bore 70 adjacent the portion of the lug which has the bore 68. The bottom of the platform also includes a downwardly depending stud pin 72, which is received in the hole 50 in the base member, and a depending block 74 having a face 76 spaced from the stud 72, positioned adjacent the rear end of the base. Moreover, a central rib 78 is located on the underside of the platform longitudinally in the space of the recess 32, except in the area above the holes 28 and at the lug 66, for additional support.

When the platform is assembled to the base a pin 80 having a reduced portion 82 is positioned in the hole 38 with the end 82 in the smaller hole 40. A spring 84 is received within an axial bore 86 in the pin 80 and a smaller pin 88 is inserted after the spring. Another spring 90 is positioned in the depression of the lug 66 axially with the bore 70 and the hole 46, and an adjusting screw 92 is received within the coils of the spring 90 and is threaded into the bore 70. The rear of the head 94 of screw 92 has a number of detents which selectively engage the pin 88 when assembled so that the platform can be adjusted laterally relative to the base member as it pivots about the stud pin 72, the springs 90 and 84 providing positive tension for fine adjustments. Another spring 96 is positioned within the hole 52 to provide an upward bias against the platform which is countered by another adjusting screw 98 received through the hole 62 and threaded into the hole 54 in the base for vertical adjustment of the platform relative to the base about the pin 80. A stop in the form of a screw (not illustrated) may be threaded into the hole 64 to prevent accidental movement of the platform once adjusted vertically.

When the sight is mounted on the gun the front of the ramp is located above the front of the gun barrel and the marksman aligns the ramp 56 within the notch 60. The eye of the marksman can quickly sight along the ramp and can maintain this alignment for extended periods relative to the prior art sights. The accuracy obtained is exceptional, especially for rapid repeated firings.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed is:

1. A target sight for hand-held firearms having a gun barrel and a frame to which the barrel is secured, said target sight comprising a base member adapted to be secured to said barrel, a platform on said base member, a rear sight upstanding rib member on said platform having a notch formed therein positioned above the frame of the gun rearwardly of the barrel, and a front sight member on said platform, said front sight member comprising an elongated ramp laterally aligned with said notch positioned above the barrel at the front thereof and extending rearwardly to a rear terminus disposed rearwardly of the barrel adjacent said rear sight, said ramp being tapered from a maximum elevation adjacent the front above the barrel to a minimum elevation below the notch at the rear.

2. A target sight as recited in claim 1 including means for adjustably attaching said platform to said base member for selective movement of said platform relative to said base member, said means including journal means for pivotably mounting said platform for limited pivotal movement in a lateral plane, and adjusting means for selectively pivoting said platform in said plane about said journal means.

3. A target sight as recited in claim 1 wherein said ramp is tapered from said maximum elevation at a constant angle.

4. A target sight as recited in claim 2 wherein said journal means comprises a stud pin on the underside of said platform extending substantially normal to said lateral plane, and an aperture in said base for journally receiving said pin for relative turning therebetween.

5. A target sight as recited in claim 4 wherein said adjusting means includes a lug on the underside of said platform, said lug having first and second adjacent bores parallel to said lateral plane, the first of said bores having threads formed therein, a recess formed in said base member for receiving said lug, first and second hole means in said base member communicating with said recess and disposed in alignment with said respective first and second bores, a threaded screw positioned in said first hole means and threaded into said first bore, said screw having a head disposed outside said recess and overlaying said second hole means a coil spring disposed about said screw and abuting said lug and said base, and a pin positioned in said second hole means and said second bore and biased outwardly into engagement with said head, whereby rotation of said head moves said platform selectively about said stud pin.

6. A target sight as recited in claim 1 wherein said ramp extends into abutting engagement with said rear sight rib.

7. A target sight for hand-held firearms having a gun barrel, said target sight comprising a base member adapted to be secured to said barrel, a platform positioned on said base member, a rear sight upstanding rib member having a notch carried on said platform adjacent one end thereof, an upstanding front sight member carried on said platform at least adjacent said other end and laterally aligned with said rear sight, means for adjustably attaching said platform to said base member for selective movement of said platform relative to said base member, said means including journal means for pivotably mounting said platform for limited pivotal movement in a lateral plane, and adjusting means for selectively pivoting said platform in said plane about said journal means.

8. A target sight as recited in claim 7 wherein said journal means comprises a stud pin on the underside of said platform extending substantially normal to said lateral plane, and an aperture in said base for journally receiving said pin for relative turning therebetween.

9. A target sight as recited in claim 8 wherein said adjusting means includes a lug on the underside of said platform, said lug having first and second adjacent bores parallel to said lateral plane, the first of said bores having threads formed therein, a recess formed in said base member for receiving said lug, first and second hole means in said base member communicating with said recess and disposed in alignment with said respective first and second bores, a threaded screw positioned in said first hole means and threaded into said first bore, said screw having a head disposed outside said recess and overlaying said second hole means, a coil spring disposed about said screw and abutting said lug and said base, and a pin positioned in said second hole means and said second bore and biased outwardly into engagement with said head, whereby rotation of said head moves said platform selectively about said stud pin.

10. A target sight as recited in claim 9 wherein said stud pin is disposed adjacent one end of said platform and said lug is disposed adjacent the other end of said platform.

11. A target sight as recited in claim 5 wherein said stud pin is disposed adjacent one end of said platform and said lug is disposed adjacent the other end of said platform.

* * * * *